US005809884A

United States Patent [19]

Wise

[11] Patent Number: 5,809,884

[45] Date of Patent: Sep. 22, 1998

[54] METHOD AND APPARATUS FOR CONTROLLING A CONTINUOUS WEB PRINTING PROCESS

[76] Inventor: Roger C. Wise, 217 Candlewood Isle - 3 Fox Run, New Fairfield, Conn. 06812

[21] Appl. No.: 835,405

[22] Filed: Apr. 8, 1997

[51] Int. Cl.[6] ..... B41J 29/26

[52] U.S. Cl. ..... 101/227; 400/74

[58] Field of Search ..... 400/54, 74, 708; 101/227, 248, 483, 484

[56] References Cited

U.S. PATENT DOCUMENTS

| | | | |
|---|---|---|---|
| 5,144,891 | 9/1992 | McKenna | 101/227 |
| 5,464,289 | 11/1995 | Beaudry | 101/227 |
| 5,489,091 | 2/1996 | Greer | 101/227 |
| 5,492,423 | 2/1996 | Smith | 400/74 |
| 5,518,329 | 5/1996 | Beaudry | 101/227 |
| 5,607,145 | 3/1997 | Lovell | 101/227 |
| 5,628,574 | 5/1997 | Crowley | 400/74 |

*Primary Examiner*—Edgar S. Burr
*Assistant Examiner*—Steven S. Kelley
*Attorney, Agent, or Firm*—Ware, Fressola, Van Der Sluys & Adolphson, LLP

[57] ABSTRACT

A method and apparatus for controlling a continuous web printing process is disclosed. In the method, a computer index file is created which tracks the status of all printed logical segments on the web. Based on the status of a record relating to a particular logical segment or the status of other associated logical segments, the particular logical segment is either accepted or rejected. The status of a record is set by scanning the logical segment for errors.

4 Claims, 9 Drawing Sheets

METHOD AND APPARATUS FOR CONTROLLING A CONTINUOUS WEB PRINTING PROCESS

BACKGROUND OF THE INVENTION

1. Field of the Invention

The present invention generally relates to a continuous web printing process. More specifically, the present invention relates to a method for controlling a continuous web printing process to ensure that all data records from a data file are printed substantially without error on a continuous web.

2. Description of the Prior Art

Continuous web printing processes are used to print telephone bills, mass mailings and other information from computer databases. Generally, in continuous web printing processes, webbing material from a supply spool is passed sequentially through a printer. Typically, the printer prints information from a computer database, for example, on the continuous webbing. The webbing containing the printing thereon is gathered on a take-up spool.

To efficiently use the webbing material, the computer database records are typically printed on both sides of the web in a sequential manner. For example, if a telephone bill for a particular customer constitutes five pages, pages one, three and five will be printed on a first side of the web, pages two and four will be printed on the opposite side of the web. Page two will be printed on the opposite side of page one and page four will be printed on the opposite side of page three.

In addition to printing unique customer records from the computer database, other non-record information, such as the logo and address of a telephone company, optical markers, tags or other similar graphic codes are also printed at precise locations on the webbing. The optical markers, tags and other similar graphic codes are used for specific printing or finishing activities. In some cases, the additional printing or finishing steps require the webbing to be despooled from the take-up spool.

While initial printing steps may be completed successfully, it is possible that later printing steps may not be completed successfully. For example, although the computer database record for a telephone bill for a particular customer printed successfully on the continuous web, a later printing process for applying the logo of the billing company to webbing material, for example, failed. The failure of the logo printing process on a particular page of a customer's telephone bill means that the remaining sequential pages of the telephone bill must be discarded and the bill for that customer reprinted if the quality of the billing information and presentation to the customer is to be maintained.

SUMMARY OF THE INVENTION

Accordingly, it is one object of the present invention to control a continuous web printing process so that the records from a database are satisfactorily printed.

This object is accomplished, at least in part, by providing a method and apparatus for controlling a continuous web printing process. The method contemplates providing a first continuous web of printing material having a printable side, a master data file D with a plurality of data records, and a web index file W. Next, the method of the present invention prints: a logical segment marker $M_n$ on a portion of the printable side of the continuous web; a logical segment marker $M_{n+1}$ on a portion of the printable side of the continuous web wherein the logical segment markers define to a logical segment $S_n$ on the printable side of the continuous web positioned between logical segment marker $M_n$ and logical segment marker $M_{n+1}$; and data $P_n$ from data record $D_n$ of the master data file on logical segment $S_n$ on the printable side of the continuous web. After the aforementioned items are printed, the method further contemplates reading logical segment markers $M_n$ and $M_{n+1}$ to identify logical segment $S_n$; creating a record $W_n$ in the web index file for logical segment $S_n$, and reading printed data $P_n$ printed within logical segment $S_n$. According to the method of the present invention, the data read from logical segment $S_n$ is stored as record $W_n$ of the web index file. The data stored in web index file record $W_n$ is compared with data record $D_n$ printed from the master data file to determine whether the printed data $P_n$ contains an error based upon the comparison. If an error is determined based upon the comparison, web index file record $W_n$ for logical segment $S_n$ is flagged to indicate an error in printed data $P_n$. The aforementioned steps are repeated as the continuous web is advanced for each logical segment.

Once the data records have been printed on the web, the method of the present invention undertakes steps to identify all flagged web index file records and all web index file records associated with flagged web index file records. The method further provides a reprint data file R and the method transfers data records corresponding to all flagged web index file records identified as well as all associated web index file records from the master data file D to the reprint data file R.

Finally, the data records from the reprint data file R are printed onto a continuous web in the same manner described for the records in the master data file B. The steps of the method of the present invention may be repeated over and over until all records in the master data file D have been printed successfully, as determined by the method.

While the method of the present invention has been described in context to the printing of data records on the continuous webbing, the method may also be employed in other web finishing steps such as the printing of color logos, the application of perforations to the webbing, as well as the sorting of webbing material once the integrity of the webbing material has been breached.

In view of the summary of the present invention having now been described, other objects and advantages of the present invention will become apparent to those skilled in the art from the following detailed description read in conjunction with the attached drawings and claims appended hereto.

BRIEF DESCRIPTION OF THE DRAWINGS

The drawings, not drawn to scale, include.

BEST MODE FOR CARRYING OUT THE INVENTION

The Apparatus For Implementing The Method of the Present Invention

Figure 1:
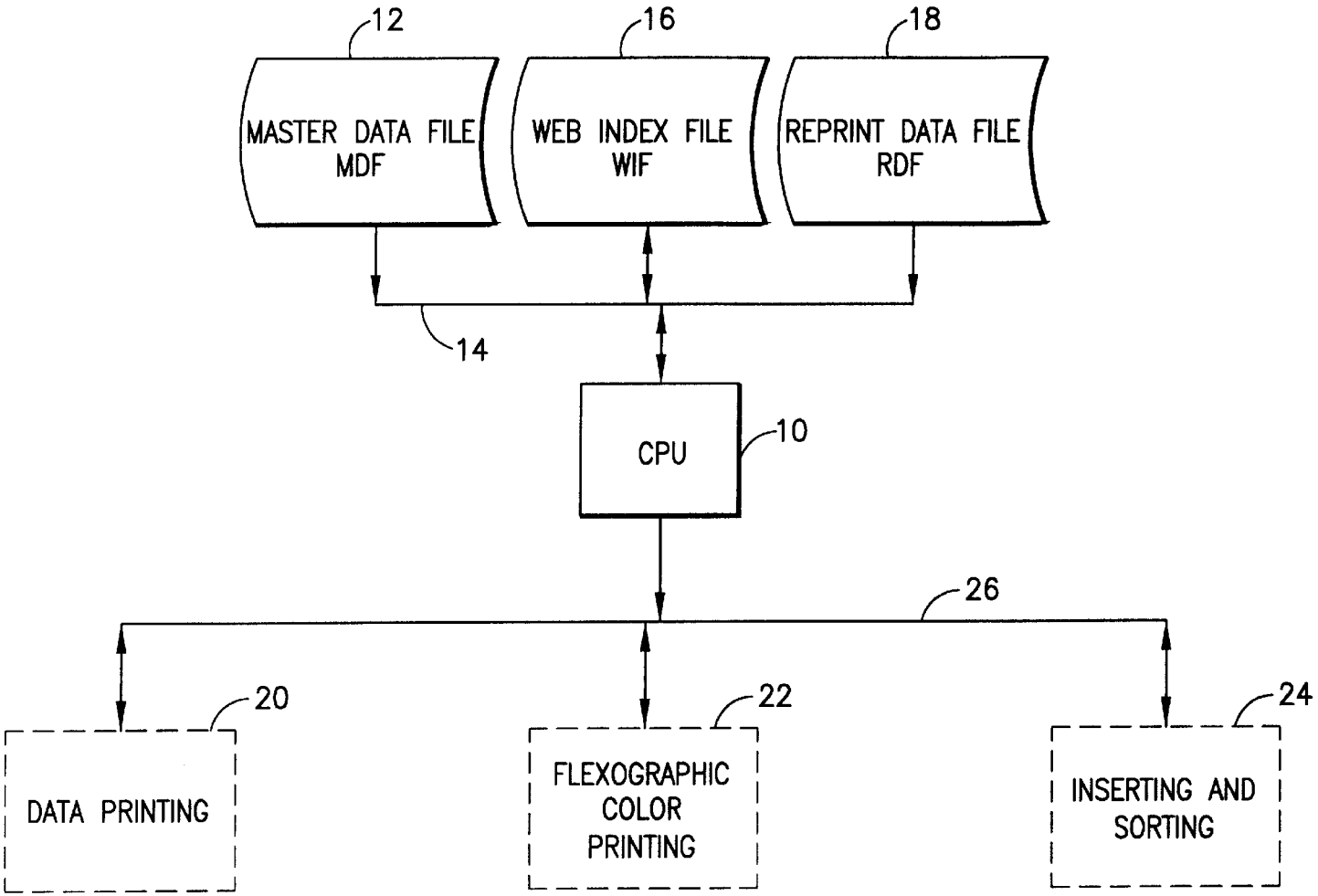
FIG. 1 is a basic schematic diagram of the apparatus upon which the method of the present invention may be carried out.

Referring to FIG. 1, the apparatus for implementing the method of the present invention includes a central processing unit (CPU) 10, a Master Data File storage device 12 that is connected to the CPU via bus 14, a Web Index File storage device 16 connected to the CPU via bus 14, and a Reprint Data File 18 storage device also connected to the CPU via bus 14. The CPU 10 is connected to the data printing apparatus generally shown as 20, the flexographic printing apparatus 22 and the inserting and sorting apparatus 24 via bus 26.

Figure 2:
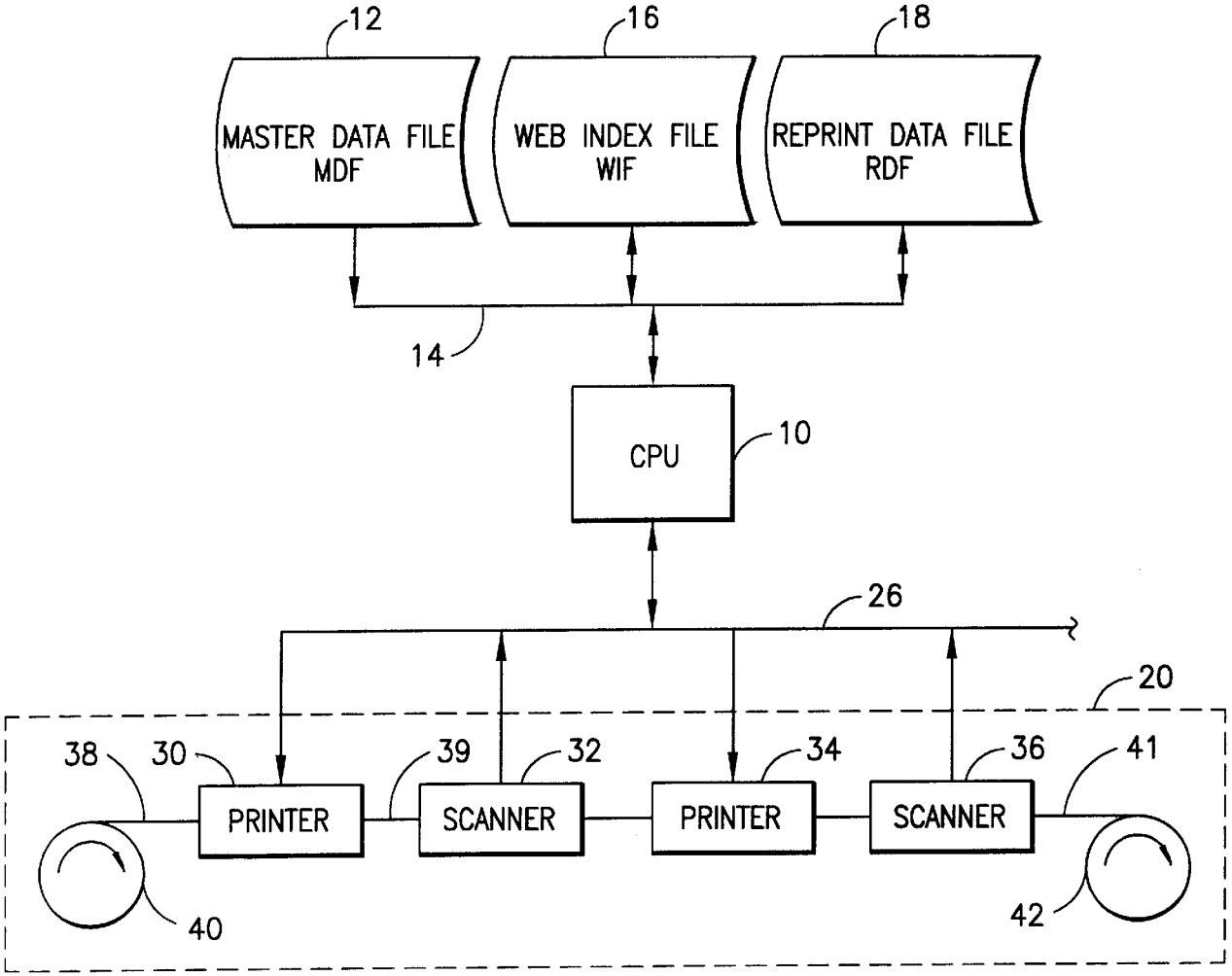
FIG. 2 is a more detailed schematic diagram of the printing portion of the apparatus upon which the method of the present invention may be carried out.

Referring now to FIG. 2, the data printing apparatus 20 preferably further comprises a first printer 30, a first scanner 32, a second printer 34, and a second scanner 36. Blank continuous webbing 38, having a printable side, held on spindle-less unwinder 40, such as an Alfred 7 Model 7UN produced by Industria Grafica Meschi ("IGM"), is passed adjacent to the first printer 30, such as an I.B.M. or Océ high speed wide printer interfaced through an Alfred 7 Model 7FEI front end interface produced by "IGM", and a first scanner 32, such as a laser scanner produced by Datalogics.

The first printer 30 and first scanner 32 are preferably oriented so as to print on one printable side of the webbing 38. Optionally, the continuous webbing is also passed adjacent to the second printer 34 and second scanner 36. The second printer 34 and second scanner 36, such as the I.B.M. or Océ high speed wide printer and laser scanner can be oriented so as to print on the opposite side of the webbing, if printing on the opposite side of the webbing is desired. After passing through the printers and scanners, webbing 41 containing printed data records is collected on a roll spindle-less rewinder 42, such as an Alfred 7 Model 7RE produced by IGM.

Figure 3:
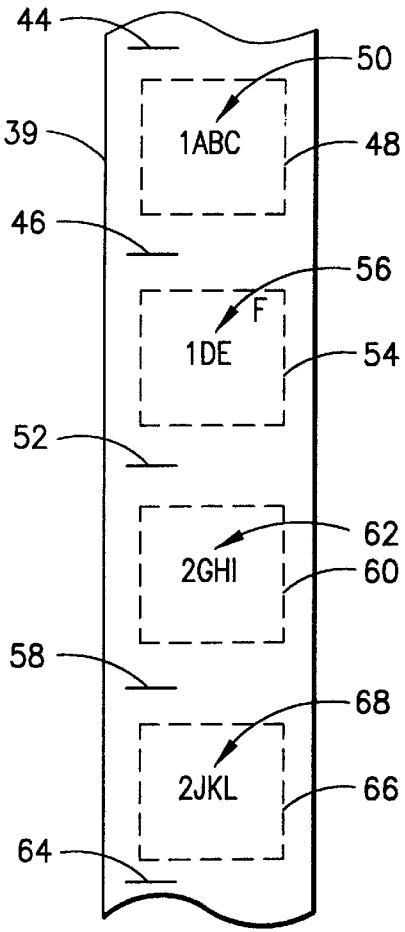
FIG. 3 is a schematic diagram of a portion of the continuous web illustrating a plurality of logical segments positioned between a plurality of logical segment markers and further illustrating data printed on the continuous web within the plurality of logical segments.

A portion of the webbing 39 containing printed data records, which has at least passed through the first printer, is illustrated in FIG. 3. The portion illustrated contains a first logical segment marker 44, a second logical segment marker 46. The first and second logical segment markers define a first logical segment 48 wherein a first data record 50 containing the alpha numeric combination "1ABC" is printed. Also illustrated as printed on the webbing 39 is a third logical segment marker 52. The second 46 and third 52 logical segment markers define a second logical segment 54 in which a second data record 56 containing the alpha numeric combination "1DEF" is printed. A fourth logical segment marker 58 is also printed on the webbing 38. The third 54 and the fourth 58 logical segment markers define a third logical segment 60 wherein a third data record 62 containing the alpha numeric combination "2GHI" is printed. A fifth logical segment marker 64 is printed on the webbing 39. A fourth logical segment 66 is defined between the fourth 58 and the fifth 64 logical segment markers. A fourth data record 68 containing the alpha-numeric combination "2JKL" is printed in the fourth logical segment.

For the purpose of the explaining the method of the present invention, the first data record 50 and the second data record 56 are associated as indicated by the numeral 1 in each of the records while the third data record 62 and the fourth data record 68 are associated as indicated by the presence of the numeral 2. In the second logical segment 54, the letter F in the alpha-numeric combination "1DEF" is intentionally offset to represent an erroneously printed data record. The method of the present invention will reject each logical segment that is printed erroneously as well as reject all associated logical segments, and it will reprint each erroneously printed logical segment as well as all associated logical segments. In the example described above and illustrated by FIG. 3, the first 48 and second 54 logical segments will be rejected and reprinted by the method of the present invention either on the same continuous webbing material if sufficient webbing material remains after printing of all records from the master data file or such reprinting will be carried out on another continuous web.

Figure 4:
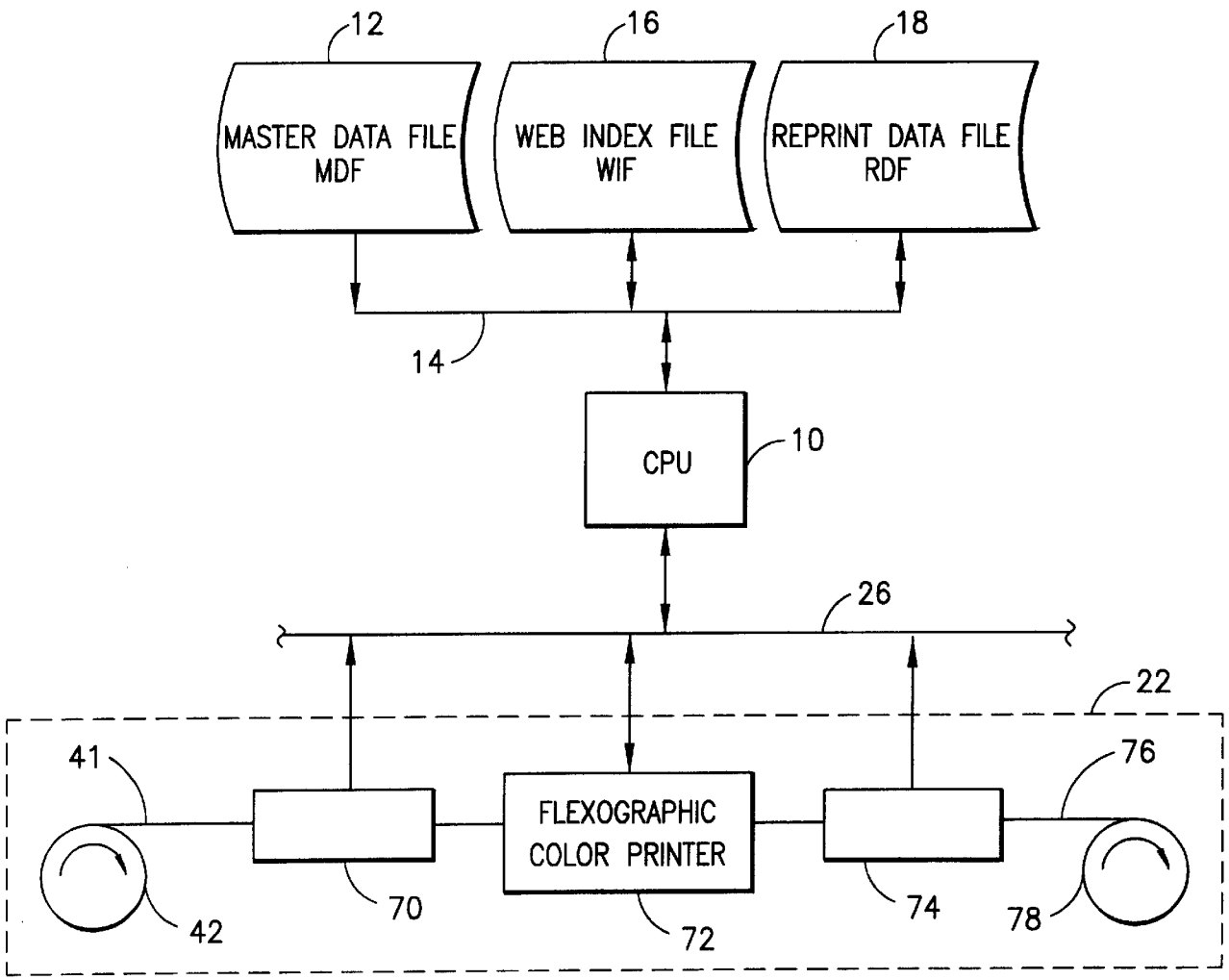
FIG. 4 is a more detailed schematic diagram of the Flexographic color printing apparatus upon which the method of the present invention may also be carried out.

Referring to FIG. 4, after the webbing 41 is collected on rewinder 42, the webbing 41 is transferred to the flexographic color printing apparatus 22. The Flexographic printing apparatus further comprises a first scanner 70, a flexographic color printer 72 and a second scanner 74. As those skilled in the art will appreciate, the logical segments printed on webbing 41 will be passed through the flexographic color printing apparatus 22 in a descending order. Each logical segment is scanned by the first scanner 70 prior to entry into the printer 72 for reference purposes. The Flexographic printing process is applied to the continuous web and the Flexographically printed webbing material 76 is scanned by the second scanner 74 prior to being taken up on spool 78. Errors detected during Flexographic printing are communicated to the CPU 10 via bus 26.

Figure 5:
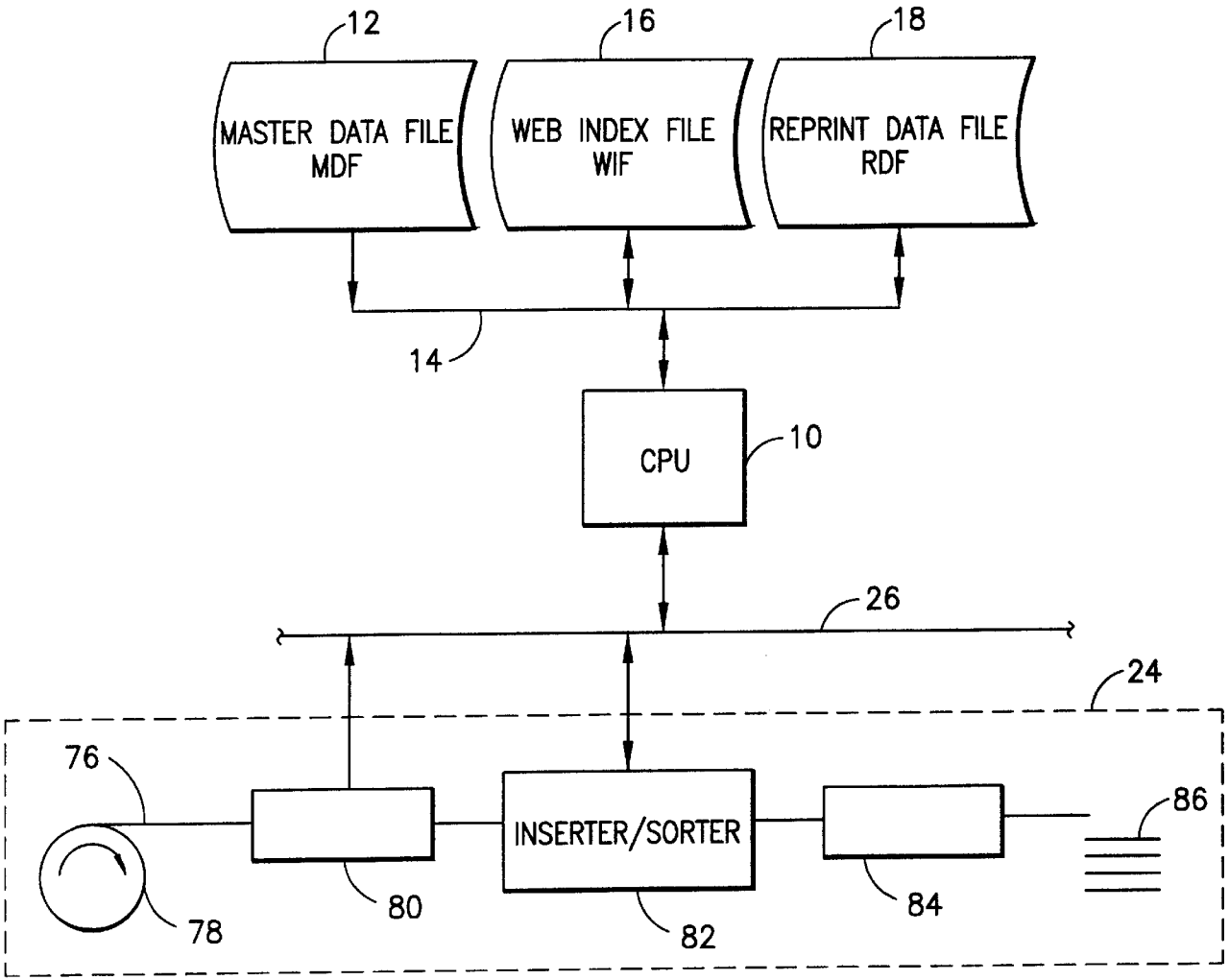
FIG. 5 is a more detailed schematic diagram of the inserter/sorter portion of the apparatus upon which the method of the present invention may also be carried out.

Referring to FIG. 5, the inserting/sorting apparatus 24 further comprises a first scanner 80, an inserting sorting apparatus 82, such as a Pitney Bowes or Bell & Howell, and a second scanner 84 located down stream. The webbing material 76 contained on spool 78 is passed through the first scanner 80 wherein the logical segments of the web are identified. The processed webbing material 76 is then passed through the inserter/sorter 82 wherein the integrity of the webbing is intentionally breached, additional materials may be inserted together with the breached web materials, and the web and inserted materials are scanned by the second scanner 84 to determine whether the insertion and sorting has occurred properly. Because the inserter/sorter apparatus is connected to the CPU 10 via bus 26, errors occurring in the inserter/sorter apparatus 24 can be communicated to the CPU 10 for process control purposes.

The Method of the Present Invention

Figure 6A:
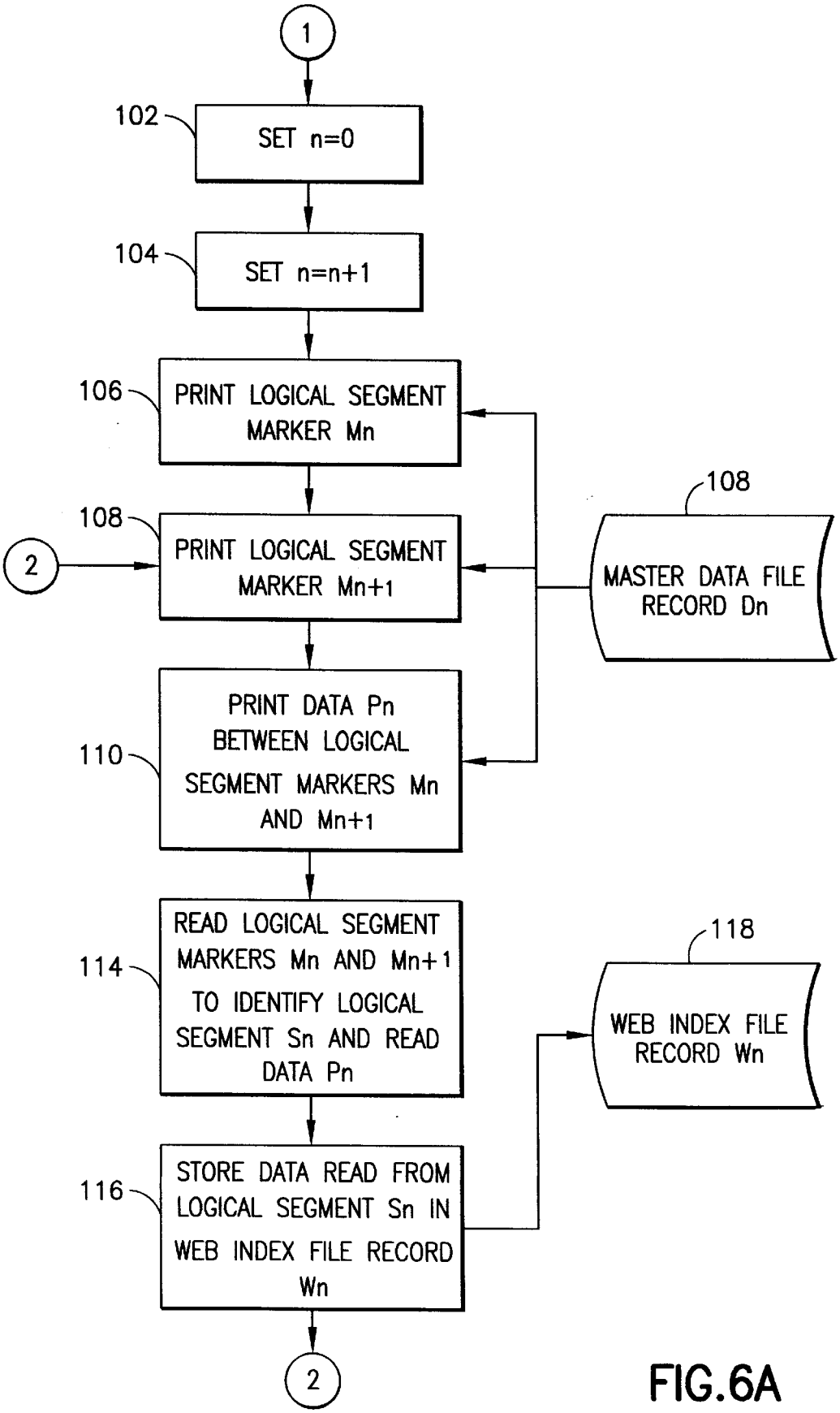
FIGS. 6A through 6E is a flow diagram describing the processing of a continuous web according to the method of the present invention on the apparatus illustrated in FIG. 1.

The method of the present invention is described in detail in the flow diagram of FIGS. 6A through 6E and the method will be best understood by reference thereto. Referring to FIG. 6A, the method of the present invention is begun by initializing counter n to zero (step 102). Once the counter is initialized the counter n is incremented by one to provide a reference for the printing of a logical segment (step 104). Once the counter is advanced, logical segment markers Mn and Mn+1 (such as 44 and 46 in FIG. 3, for example) are printed and data Pn (such as 50, FIG. 3) is printed by printer 30 in the space between logical segment markers Mn and Mn+1 (steps 106, 110 & 112) on the web 39. The data for printing the logical segment markers and data Pn is drawn from Master Data File Record Dn 108 contained in the Master Data File 12.

According to the method of the present invention, the initially printed web 39 is scanned to read the printed logical segment markers Mn and Mn+1 as well as printed data Pn to identify the printed logical segment as Sn (step 114). The data read from logical segment Sn is stored (step 116) in Web Index File Record Wn (118).

Figure 6B:
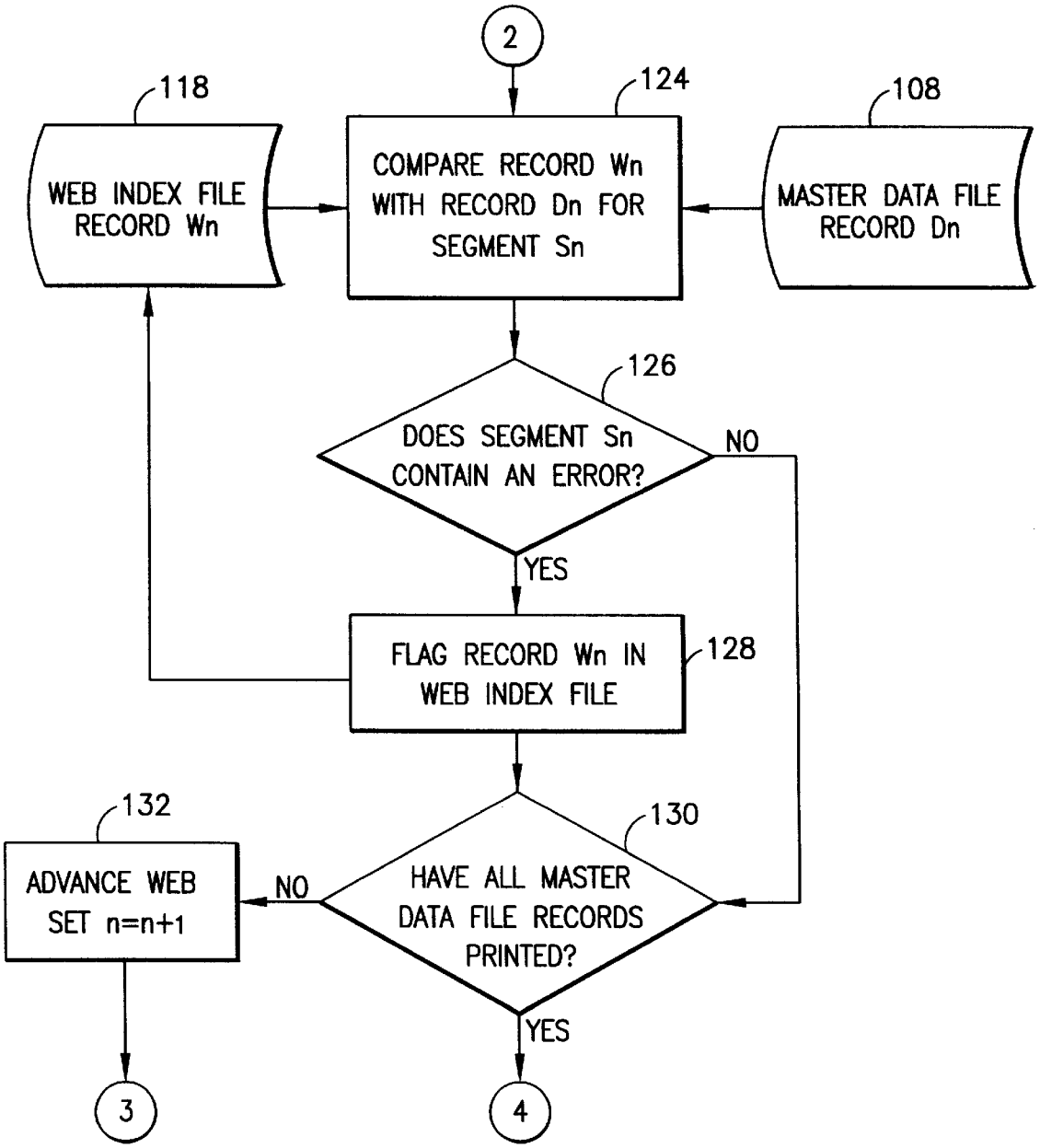

Referring to FIG. 6B, the data stored in Web Index File Record Wn (118) for segment Sn is compared to Record Dn (108) in the Master Data File (step 124) to determine whether segment Sn contains an error (step 126). According to the method of the present invention, if segment Sn contains an error, then record Wn in the Web Index File is flagged to indicate the error (step 128). If no error is determined to be present, then the method of the present invention inquires whether all of the Master Data File records have printed (step 130). If all of the records have not printed, then counter n is advanced (step 132) and steps 110 through 116 of the printing process illustrated in FIG. 6A are repeated.

Figure 6C:
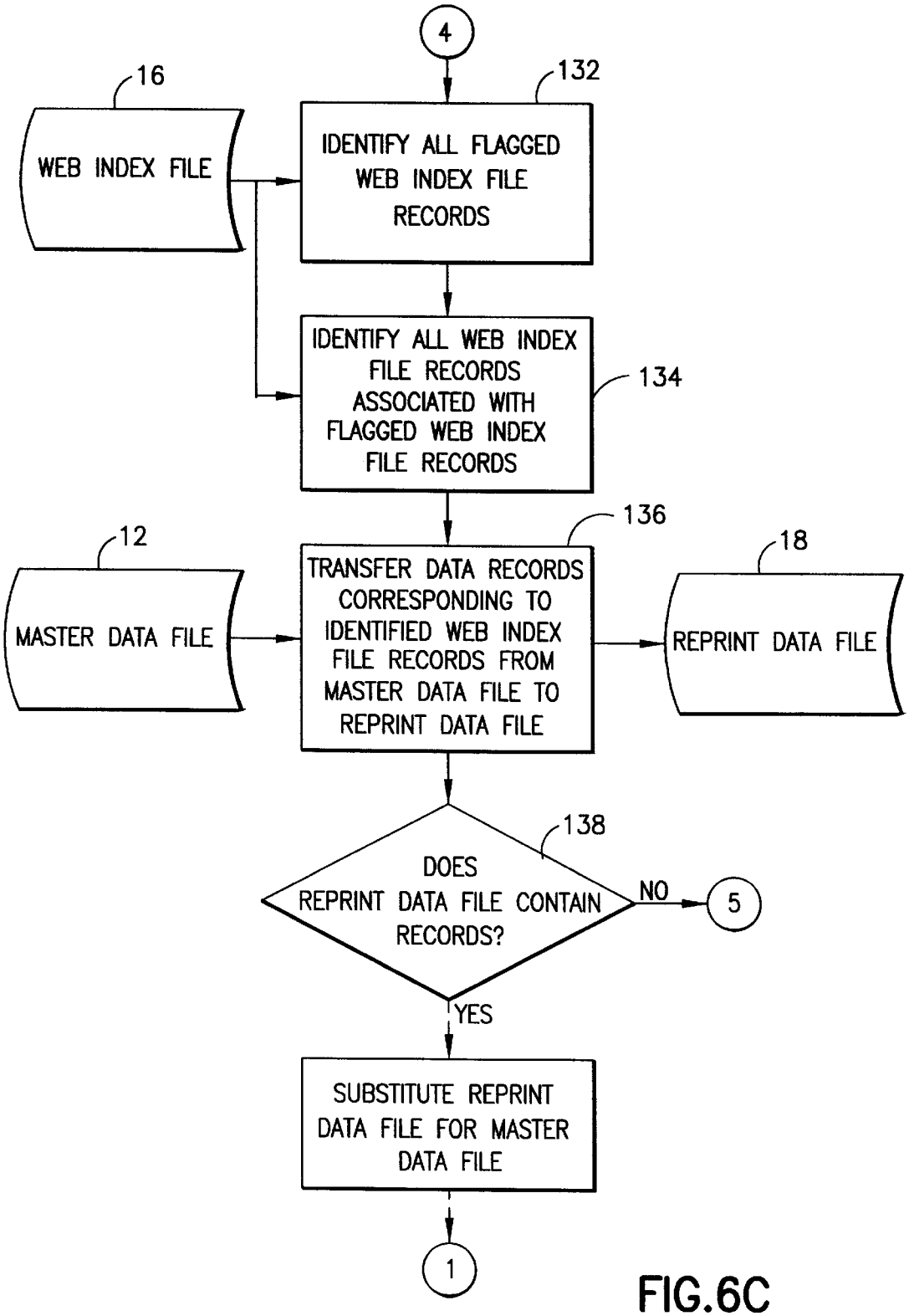

Referring to FIG. 6C, the CPU 10 reviews the Web Index File 16 to identify all flagged Web Index File records (step 132) and to further identify all Web Index File records associated with the previously identified flagged records (step 134). The data corresponding to the identified Web Index File Records contained in the Master Data File 12 are transferred to the Reprint Data File (step 136). The contents of the Reprint Data File 18 are checked (step 138) to determine whether the Reprint Data File contains any records. If records are found in the Reprint Data File, then the Reprint Data File is substituted for the Master Data File and the records contained therein are printed on the web according to the printing process illustrated in FIG. 6A. When no further files are contained in the Reprint Data File, or the end of the webbing material is reached, the printed web 41 on spool 42 is ready for flexographic printing.

Figure 6D:
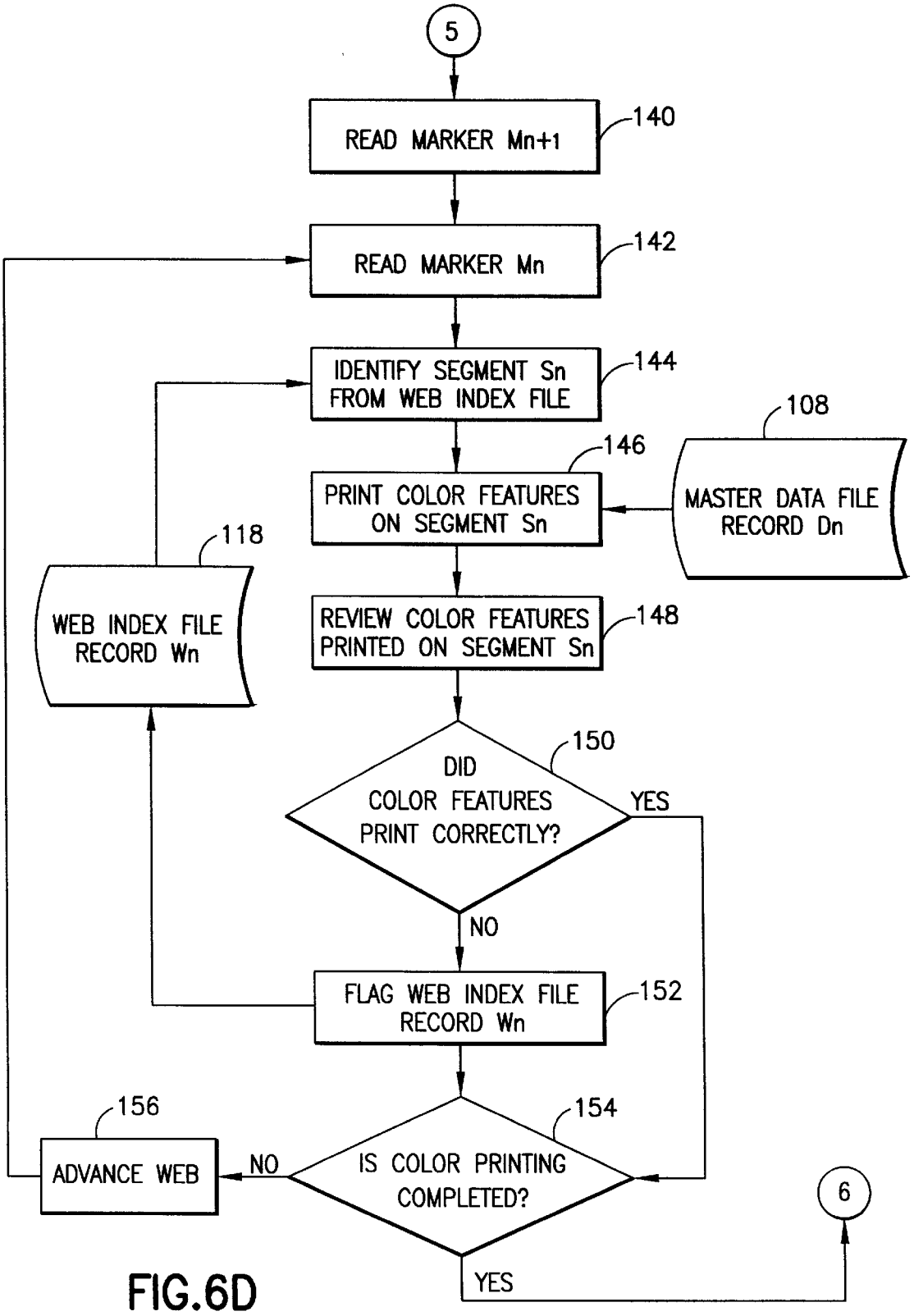

Referring to FIG. 6D, the printed web 41 on spool 42 is passed by the first flexographic scanner 70 wherein logical segment markers Mn+1 and Mn are read (steps 140 & 142) and a logical segment Sn is identified (step 144). Because the logical segment markers are fed in a descending order from the spool, logical segment marker Mn+1 is read prior to logical segment marker Mn. Once identified, color features are printed on Segment Sn according to the data record Dn contained in the Master Data File (step 146). After the color features are printed, the web is scanned again by the second scanner 74 (step 148) to determine whether the color features (step 150) printed correctly. If the color features did not print correctly, then the corresponding Web Index File record Wn 118 is flagged (step 152). The method of the present invention also determines whether the flexographic color printing is completed (step 154). If it is not completed, the web is advanced (step 156) and the process is repeated from step 142. Once the color printing is completed, as determined in step 154, the printed webbing 76 is ready for further processing.

Figure 6E:
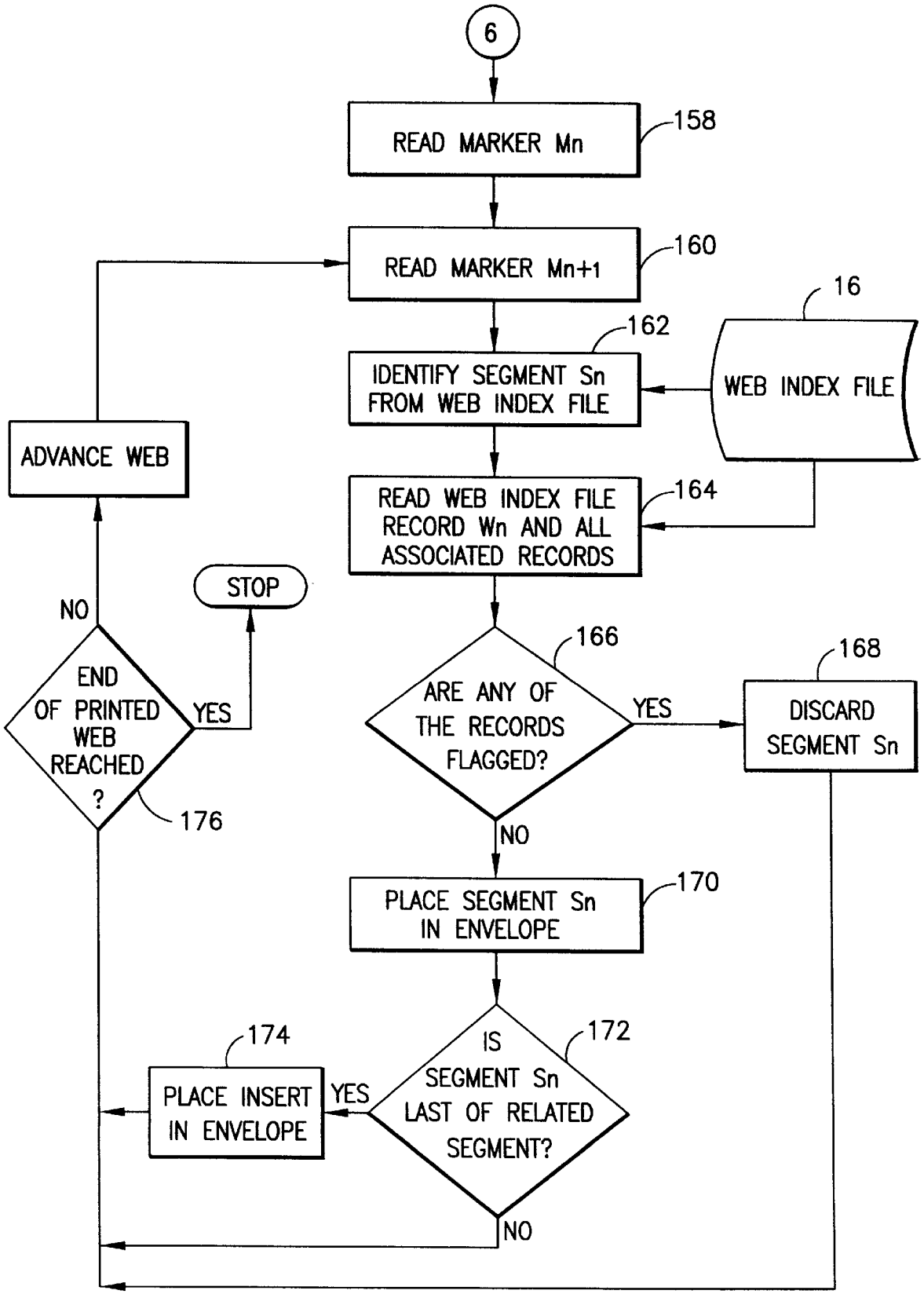

Referring to FIG. 6E, the printed webbing 76 contained on spool 78, is passed by the first scanner 80 wherein logical segment markers Mn and Mn+1 are read (steps 158 & 160) and a corresponding logical segment Sn is identified from the Web Index File (step 162). Once identified, the attributes of the logical segment Sn as well as the associated records from the logical segment Sn are read from the Web Index File (step 164). A determination is made as to whether the Web Index File record for logical segment Sn or the records associated logical segments contain flags (step 166). If the Web Index File Record for logical segment Sn or any associated logical segment contains flags, then the logical segment Sn is discarded (step 168). If no records are flagged, then logical segment Sn is placed in an envelope (step 170), for example. Also, according to the method of the present invention, a determination is made as to whether the current logical segment Sn is the last of an association of segments (step 172). If so, then an insert is placed in the envelope (step 174). Of course, after reading the detailed description of the invention herein, those skilled in the art will realize that the method of the present invention can be modified such that an insert can be placed in the envelope at any position between the first and last associated logical segments. Finally, a determination is made as to whether the end of the printed web has been reached (step 176). If so, the method of the present invention is terminated (step 178). If not, the method of the present invention calls for the web to be advanced (step 180) and the steps outlined in FIG. 6E, namely steps 160 through 176) to be repeated.

Referring to FIG. 3, under the method of the present invention, the first logical segment 48 and the second logical segment 54 would be reprinted. The printed data 56 in the second logical segment 54 contains an error. The method of the present invention will reject this logical segment as well as the first logical segment 48 to preserve the continuity of the printed records on the web.

It will thus be seen that the objects and advantages set forth above and those made apparent from the preceding descriptions, are efficiently attained and, since certain changes may be made in the above construction without departing from the scope of the invention, it is intended that the matter contained in the above description or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall therebetween.

What is claimed is:

1. A method for controlling a continuous web printing process, the method comprising the steps of:

(a) providing a counter n;

(b) providing a continuous web of printing material having a printable side;

(c) providing a master data file D with a plurality of data records;

(d) providing a web index file W;

(e) printing logical segment marker $M_n$ on a portion of the printable side of the continuous web;

(f) printing logical segment marker $M_{n+1}$ on a portion of the printable side of the continuous web to create a logical segment $S_n$ on the printable side of the continuous web between logical segment marker $M_n$ and logical segment marker $M_{n+1}$;

(g) printing data $P_n$ from data record $D_n$ of the master data file within logical segment $S_n$ on the printable side of the continuous web;

(h) reading logical segment markers $M_n$ and $M_{n+1}$ to identify logical segment $S_n$ and creating a record $W_n$ in the web index file for logical segment $S_n$;

(i) reading printed data $P_n$ printed within logical segment $S_n$;

(j) storing the data read from logical segment $S_n$ in record $W_n$ of the web index file;

(k) comparing the data stored in web index file record $W_n$ with data record $D_n$ printed from the data file;

(l) determining whether the printed data $P_n$ contains an error based upon the comparison in step (k);

(m) flagging web index file record $W_n$ for logical segment $S_n$ to indicate an error in printed data $P_n$ if an error is determined in step (l);

(n) advancing the continuous web, incrementing counter n, and repeating steps (f) through (m) for the continuous web;

(o) identifying all flagged web index file records;

(p) identifying all web index file records associated with flagged web index file records;

(q) providing a reprint data file R;

(r) transferring data records corresponding to all flagged web index file records identified in step (o) and all associated web index file records identified in step (p) from the master data file D to the reprint data file R; and (s) printing data records from the reprint data file R onto a continuous web.

2. The method of claim 1, further comprising the steps of:

(a) reading logical segment markers $M_n$ and $M_{n+1}$ to identify logical segment $S_n$; and (b) discarding logical segment $S_n$ of the first continuous web if the web index file record $W_n$ is flagged or if the web index file record $W_n$ is associated with another web index file record that is flagged.

3. An apparatus for controlling a continuous web printing process, the apparatus comprising:

(a) means for providing a counter n;

(b) means for providing a continuous web of printing material having a printable side;

(c) means for providing a master data file D with a plurality of data records;

(d) means for providing a web index file W;

(e) means for printing logical segment marker $M_n$ on a portion of the printable side of the continuous web;

(f) means for printing logical segment marker $M_{n+1}$ on a portion of the printable side of the continuous web to create a logical segment $S_n$ on the printable side of the continuous web between logical segment marker $M_n$ and logical segment marker $M_{n+1}$;

(g) means for printing data $P_n$ from data record $D_n$ of the master data file within logical segment $S_n$ on the printable side of the continuous web;

(h) means for reading logical segment markers $M_n$ and $M_{n+1}$ to identify logical segment $S_n$ and means for creating a record $W_n$ in the web index file for logical segment $S_n$;

(i) means for reading printed data $P_n$ printed within logical segment $S_n$;

(j) means for storing the data read from logical segment $S_n$ in record $W_n$ of the web index file;

(k) means for comparing the data stored in web index file record $W_n$ with data record $D_n$ printed from the data file;

(l) means for determining whether the printed data $P_n$ contains an error based upon the comparison by the means for comparing data;

(m) means for flagging web index file record $W_n$ for logical segment $S_n$ to indicate an error in printed data Pn if an error is determined by the means for determining whether the printed data $P_n$ contains an error;

(n) means for identifying all flagged web index file records;

(o) means for identifying all web index file records associated with flagged web index file records;

(p) means for providing a reprint data file R;

(q) means for transferring data records corresponding to all flagged web index file records and all associated web index file records from the master data file D to the reprint data file R; and (r) means for printing data records from the reprint data file R onto a printable side of a continuous web.

4. The apparatus of claim 3, further comprising:

(a) means for reading logical segment markers $M_n$ and $M_{n+1}$ to identify logical segment $S_n$; and (b) means for discarding logical segment $S_n$ of the first continuous web if the web index file record $W_n$ is flagged or if the web index file record $W_n$ is associated with another web index file record that is flagged.

* * * * *